US006285294B1

(12) United States Patent
Avinger

(10) Patent No.: US 6,285,294 B1
(45) Date of Patent: Sep. 4, 2001

(54) AUTOMATED DOOR KNOCKER

(75) Inventor: Andrew G. Avinger, Lubbock, TX (US)

(73) Assignee: Gary Products Group, Inc., Lubbock, TX (US)

( * ) Notice: Subject to any disclaimer, the term of this patent is extended or adjusted under 35 U.S.C. 154(b) by 0 days.

(21) Appl. No.: 09/685,640

(22) Filed: Oct. 10, 2000

(51) Int. Cl.[7] ..... G08B 3/00

(52) U.S. Cl. ..... 340/691.1; 340/691; 340/571; 340/541; 340/545.1; 340/545.3; 340/545.7; 340/328; 340/326; 340/384.1

(58) Field of Search ..... 340/691.1, 328, 340/692, 571, 384.1, 541, 545.1, 545.3, 545.7, 326

(56) References Cited

U.S. PATENT DOCUMENTS 3,938,120 * 2/1976 O'Connell ..... 340/274 R
4,100,581 * 7/1978 Slack et al. ..... 360/12
4,236,147 * 11/1980 Calvin ..... 340/553
5,900,802 * 5/1999 Segan ..... 340/328

* cited by examiner

*Primary Examiner*—Daniel J. Wu
*Assistant Examiner*—Tai T. Nguyen
(74) *Attorney, Agent, or Firm*—Locke Liddell & Sapp LLP; Monty L. Ross

(57) ABSTRACT

An automated and seemingly animated door knocker is disclosed that includes a housing with a pivotably connected knocking member, the housing being releasably supported on the door by an over-the-door hanger or other similarly satisfactory attachment device, and the knocking member being reciprocated by a battery-powered, motor-driven linkage that is controlled by an integrated circuit and activated by a difference in light intensity as sensed by a photocell when someone approaches the door. A sound generator controlled from the circuit board is also desirably activated contemporaneously with the motor-driven linkage to play a prerecorded sound sequence.

7 Claims, 4 Drawing Sheets

AUTOMATED DOOR KNOCKER

BACKGROUND OF THE INVENTION

1. Field of the Invention

This invention relates to door knockers and, more particularly, to a door knocker that senses the proximity of an individual to a door and commences knocking and simultaneously playing a recorded message without any other involvement by the individual.

2. Description of Related Art

Although user-operated door knockers are well known, a novelty type door knocker is needed, particularly for festive, holiday or seasonal use, that is fully automated and that combines the knocking function with the playing of a prerecorded greeting, message, music or other sound effect or sequence.

SUMMARY OF THE INVENTION

This invention relates to door knockers and, more particularly, to a door knocker that senses the proximity of an individual to a door and commences knocking and simultaneously playing a recorded message without any other involvement by the individual approaching the door. According to one preferred embodiment of the invention, a novelty type door knocker is provided, particularly for festive, holiday or seasonal use, that is fully automated or seemingly animated and that combines a simulated knocking function with the playing of a prerecorded knocking sound, greeting, message, music or other sound effect or sequence. The automated "self-knocking" feature is desirably achieved by means of a battery-powered, motor-driven linkage inside the knocker housing. The motor is controlled by a circuit that is activated by a signal from a photocell which detects variations in light intensity as an individual approaches a door on which the device is mounted or supported. The sound generation device is also preferably controlled by the circuit to play prerecorded sounds while the knocker is moving. The subject door knocker is desirably supported on a door by an over-the-door hanger but can also be attached to a door by any other similarly satisfactory attachment device.

According to another embodiment of the invention, an automated and seemingly animated door knocker is disclosed that includes a housing with a pivotably connected knocking member, the housing being releasably supported on the door by an over-the-door hanger or other similarly satisfactory attachment device, and the knocking arm being reciprocated by a battery-powered, motor-driven linkage that is controlled by an integrated circuit board and activated by a difference in light intensity as sensed by a photocell when someone approaches the door. A sound generator controlled from the circuit board is also desirably activated contemporaneously with the motor-driven linkage to play a prerecorded sound sequence.

BRIEF DESCRIPTION OF THE DRAWINGS

The apparatus of the invention is further described and explained in relation to the following figures of the drawings wherein.

Figure 1:
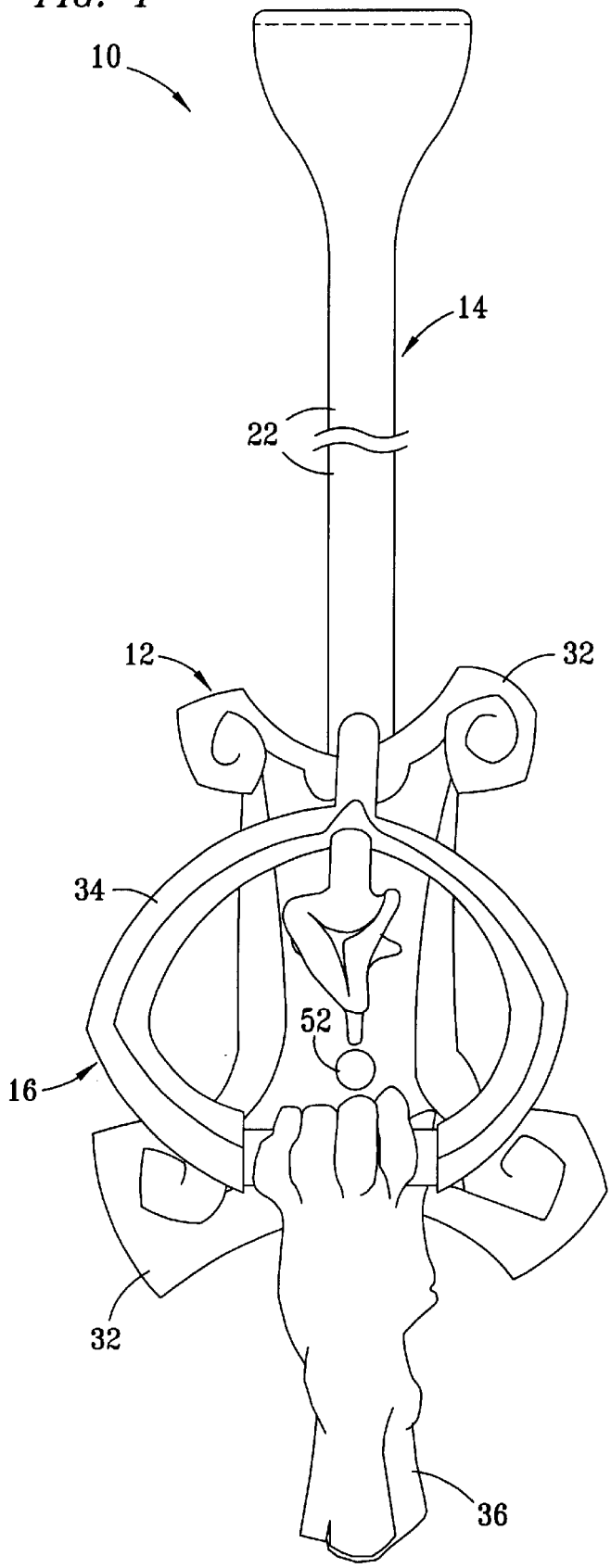
FIG. 1 is a front elevation view of the automated door knocker of the invention.

Like reference numerals are used to indicate like parts in all figures of the drawings but it should be understood that all subject matter depicted in individual views is not drawn to scale and that scale may also vary from one view to another. The layout of the printed circuit board and electrical connections between some component parts are omitted to simplify the drawings. It is understood, however, that printed circuit boards having the functionality described herein are commercially available, and that the interconnections of components will be readily apparent to those of ordinary skill in the art upon reading the specification in relation to the drawings.

DESCRIPTION OF THE PREFERRED EMBODIMENTS

A significant feature of the automated door knocker disclosed herein is that it "senses" the arrival of an individual approaching a door and begins moving in a knocking motion and emitting a sound, most preferably, first emitting a "knocking" sound coordinated with the motion, and then emitting a greeting, song, or other sound effect. "Automated" is therefore used in the sense that the knocking action and sound generation features are both initiated from within the device. The sensing function can be performed by any of several commercially available devices including, for example, by infrared or ultrasonic sensors, or by the use of a photocell. The preferred sensor for use in the invention is a photocell that functions in cooperation with an electrical circuit to initiate preprogrammed, and optionally preselected, knocking and sound sequences in response to a change in the amount of light entering the photocell. Such variations in the intensity of light reaching the facing surface of a door typically occur when an individual approaches the door, either because the individual blocks out a portion of the light that is otherwise available or because the skin, clothing or jewelry of the individual reflect additional light onto the door.

Referring to FIG. 1, automated door knocker 10 of the invention preferably comprises housing 12 with forwardly facing, decorative body 32, housing support member 14 and knocker member 16 that is pivotably connected to housing 12. Housing 12 is preferably made of a moldable polymeric resin and contains at least one battery, a motion sensor, a motor, a mechanical linkage driven by the motor that is suitable for reciprocating the knocker arm, a sound generator, and a printed circuit board comprising conventional circuitry and components adapted to interconnect and control the elements of the door knocker as described in greater detail below. Housing support member 14 is preferably an over-the-door hanger made of molded plastic or metal that is attachable, and most preferably releasably attachable, to both housing 12 and to a conventional door. Vertical portion 22 of housing support member 14 can be of any desired length, although a length sufficient to support housing 12 between the eye and chest levels of a typical adult is preferred. Also, while the use of an over-the-door hanger as housing support member 14 is preferred, it will be appreciated by those of ordinary skill in the art upon reading this disclosure that other similarly effective devices can likewise be used for releasably attaching housing 12 to, or for properly positioning housing 12 relative to, the exterior surface of a door.

Automated door knocker 10 is most preferably used as a novelty or seasonal item, and it is understood that the outward appearance of housing 12 and knocker member 16 can differ greatly from those disclosed herein within the broad scope of the invention. As shown in the drawings, automated door knocker 10 is intended for seasonal use around Halloween, and knocker member 16 comprises for illustrative effect a ring member 34 having a simulated dismembered hand 36 grasping the ring. When automated door knocker 10 is made for and intended for use with this or another festive, seasonal or holiday theme, the prerecorded sound sequence emitted by the sound generator as described below will also desirably relate in some manner to the theme.

Figure 2:
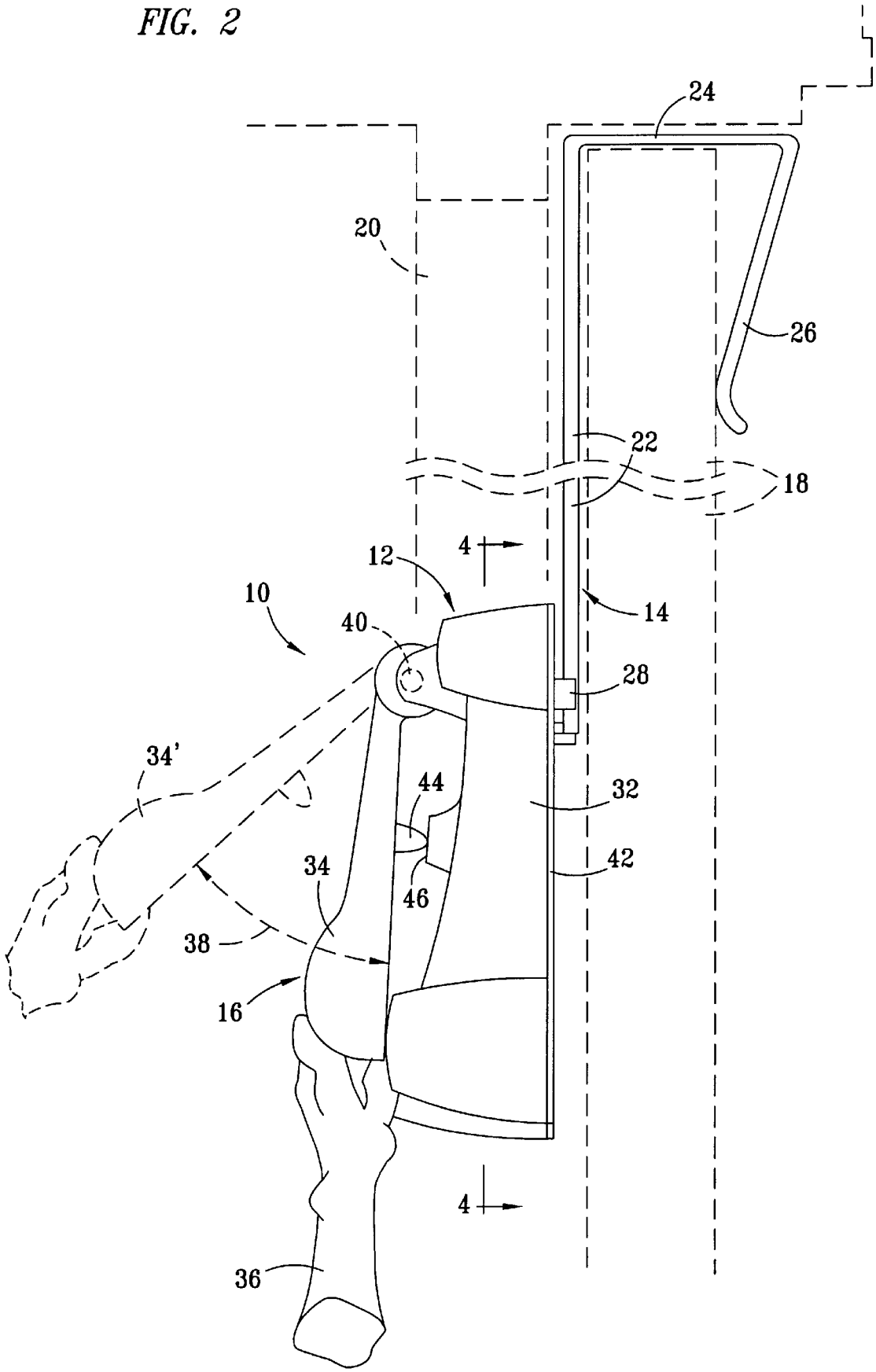
FIG. 2 is a side elevation view of the door knocker of FIG. 1, further depicting in dashed outline a door over which the door knocker is installed and an alternate position of the knocking arm when rotated outwardly from the rest position.

Referring to FIG. 2, housing 12 preferably further comprises a hollow or partially hollow body 32 having a back cover 42 with a rearwardly projecting boss 28 or another similarly effective attachment device for attaching housing 12 to housing support member 14. Housing support member 14 is preferably an over-the-door hanger 14 having a vertical support portion 22 attached to housing 12 at boss 28. Vertical support portion 22 is preferably made unitarily with transverse over-the-door portion 24 and downwardly directed, resilient hook portion 26, and is employed in the present invention to suspend housing 12 at a desirable height in front of the door. Transverse portion 24 and resilient hook portion 26 are desirably sized to accommodate doors 18 of commonly occurring thicknesses as shown in FIG. 2. Door jamb 20 is also shown in FIG. 2 in relation to door 18 of the doorway in which automated door knocker 10 is installed. The thickness, width and material of choice for use in making housing support member 14 will depend of course on the size and weight of the door knocker with which it is used. Knocker member 16 is shown as being pivotally connected to housing 12 by rotatable shaft 40, which permits the lower portion of ring 34 to be moved alternately away from and toward housing 12, as indicated by arrow 38 and alternate position 34', during knocking. Knocker member 16 also preferably comprises an inwardly projecting striker 44 that repeatedly contacts, or at least closely approaches, striker plate 46 of housing 12 to simulate striking whenever knocker member 16 is automatically reciprocated as discussed herein.

Figure 3:
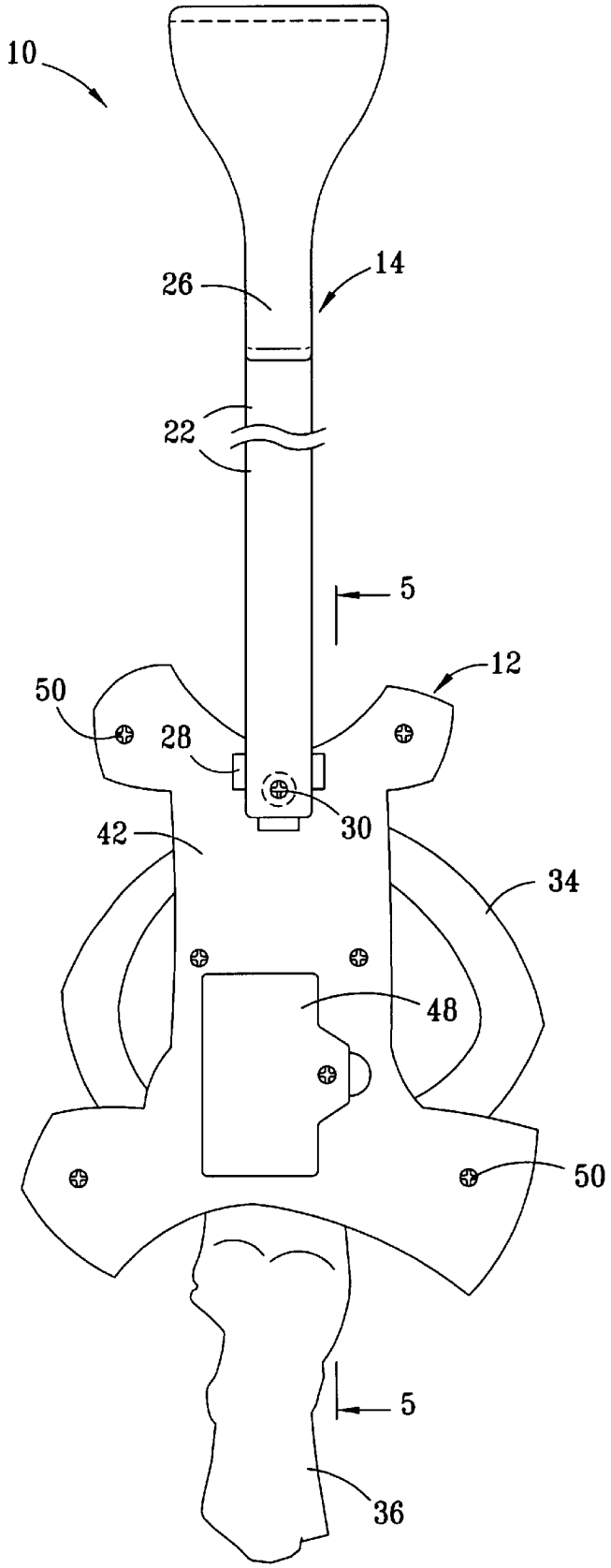
FIG. 3 is a rear elevation view of the automated door knocker of FIG. 1.

FIG. 3 is a rear view of automated door knocker 10 of FIG. 1. From this perspective it is seen than elongated vertical support member 22 of housing support member 14 is attached to boss 28 of rear cover 42 by screw 30, and that rear cover 42 is attached to housing 12 by a plurality of screws 50, although other similarly effective attachment means can also be used. Removable battery cover 48 is also desirably provided in back cover 42 for easy access.

Figure 5:
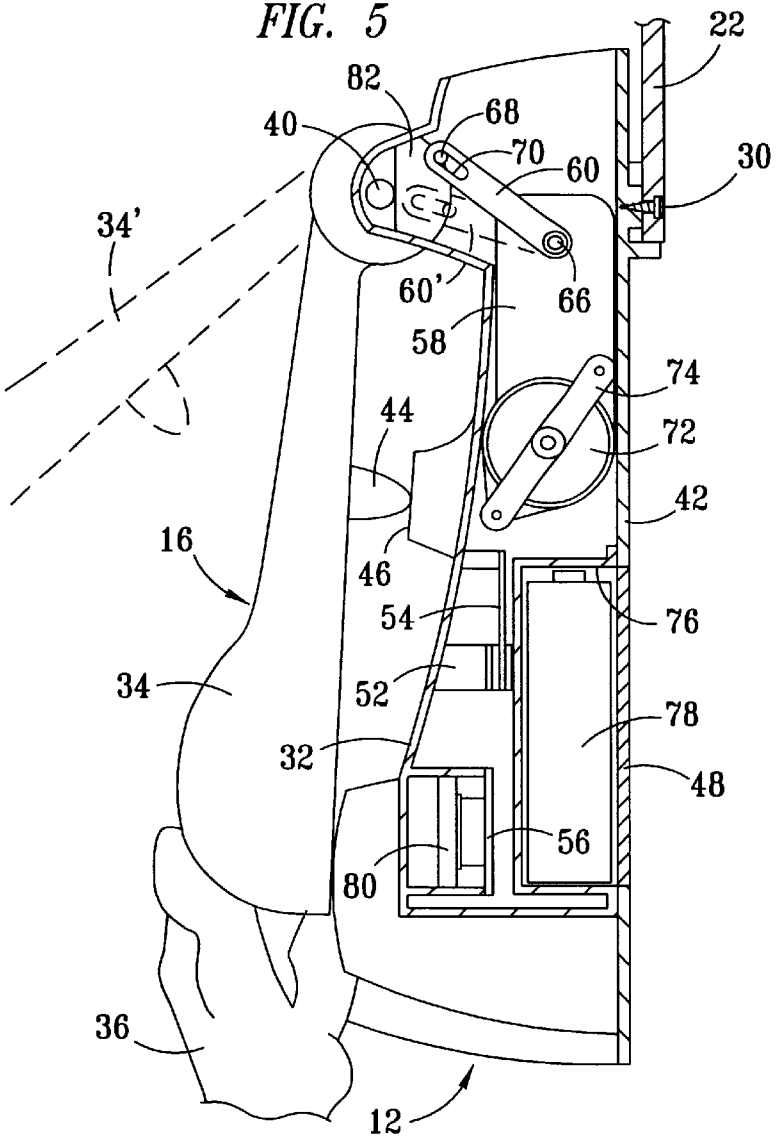
FIG. 5 is an enlarged cross-sectional view taken along line 5—5 of FIG. 3.
Figure 4:
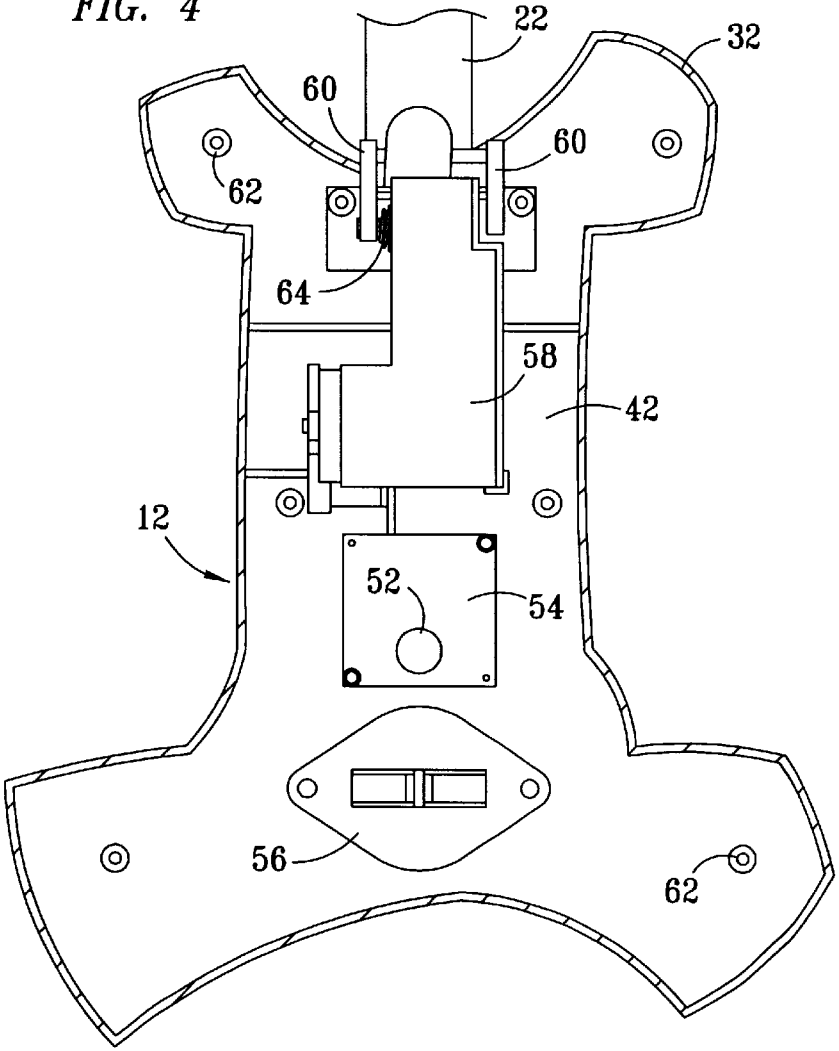
FIG. 4 is an enlarged rear elevation view of the door knocker housing, taken along line 4—4 of FIG. 2.

The internal structure and operation of automated door knocker 10 are further described and explained in relation to FIGS. 4 and 5. Photocell 52, preferably a cadmium disulfide photocell, is positioned so as to receive ambient light, either natural or artificial, through the face of body 32 of housing 12. The aperture in body 32 through which photocell 52 receives light should not be blocked by knocker arm 34 or striker 44. Photocell 52 is also desirably proximal to and is electronically interconnected with integrated circuit board 54, which comprises electronic components necessary to activate motor 72 and speaker 80 supported on speaker mount 56 when the light intensity as sensed by photocell 52 changes by a predetermined quantity within a predetermined interval. The power supply for all electrical components of the door knocker preferably comprises one or more batteries 78 disposed in receptacle 76 behind door 48 in back cover 42. Motor 72 is maintained inside motor and gear housing 58 by retainer 74 and, when activated, causes gears not visible under cover 58 to rotate connecting rod clevis 60 and shaft 66 downwardly from the position shown in solid outline in FIG. 5 to the position shown by dashed outline 60' in FIG. 5, against the bias of coil spring 64 that is visible in FIG. 4. When connecting rod clevis 60 is rotated downwardly, pin 68 that extends through pivotable member 82 of knocker member 16 slides to the opposite end of slots 70, causing the lower portion of knocker member 16, including ring 34 and dismembered hand 36, to be rotated outwardly to a position as indicated by dashed outline as 34'. When driven by motor 72, knocker member 16 slowly reciprocates and striker 44 repeatedly contacts or approaches striker plate 46 to simulate knocking. The knocking motion desirably continues for a predetermined and preprogrammed interval or number of motion cycles of knocker member 16. Simultaneously, a sound transducer such as speaker 80 is also energized to play prerecorded sounds for a predetermined interval prior to, during or after the motion cycle. Such sounds may include, for example, a loud knocking sound, a verbal greeting, a song, a startling sound effect, or the like, or any combination thereof. According to a particularly preferred embodiment of the invention, speaker 80 begins playing a knocking sound that is coordinated with the motion of knocker member 16 to simulate knocking.

After a predetermined period of operation, an electronic controller on circuit board 54 deenergizes motor 72 to stop the knocking motion of knocker member 16 and return the automated door knocker to its resting state until it is again activated by another change in light intensity. The sound generator is desirably programmed so that, when knocker member 16 ceases movement, speaker 80 begins emitting a different sound sequence, such as a greeting , song or other sound effect, for a second predetermined interval. When playing of the preprogrammed sound sequence is completed, the entire apparatus preferably returns to a resting state until again activated for another cycle of operation as described herein.

While the operation of automated door knocker 10 is described herein with a change of light intensity constituting the triggering event, it will be appreciated that other motion sensing devices can likewise be used and can rely on other sensed conditions, properties or inputs as the triggering event for activation of the invention.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. An automated door knocker comprising a housing, a housing support member connectable to the housing and releasably attachable to a door, and a knocker member pivotally connected to the housing, the housing further comprising at least one battery, a motor, a linkage operatively coupling the motor to the knocker member so as to reciprocate the knocker member in response to operation of the motor, a sound generator, a motion sensor, and an integrated circuit board;

the integrated circuit board selectively interconnecting and controlling the battery, motor, sound generator and motion sensor to activate the motor and sound generator in response to motion sensed in an area proximal to the door.

2. The door knocker of claim 1 wherein the motion sensor is a photocell, and the motor and sound generator are activated in response to predetermined variations in light intensity.

3. The door knocker of claim 1 wherein the housing support member is an over-the-door hanger.

4. The door knocker of claim 1 wherein the knocker member comprises a decorative form.

5. The door knocker of claim 4 wherein the decorative form comprises a ring.

6. The door knocker of claim 4 wherein the decorative form comprises a dismembered hand.

7. The door knocker of claim 1 wherein the sound generator, when activated, emits prerecorded sounds for a predetermined interval.

* * * * *